US009433275B2

(12) United States Patent
Crawford et al.

(10) Patent No.: US 9,433,275 B2
(45) Date of Patent: Sep. 6, 2016

(54) STICK PRODUCT DISPENSING SYSTEM

(71) Applicant: COLGATE-PALMOLIVE COMPANY, New York, NY (US)

(72) Inventors: John C. Crawford, Mahopac, NY (US); Kiat-Cheong Toh, Forest Hills, NY (US); Kenneth Reed, Edison, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/441,495

(22) PCT Filed: Nov. 16, 2012

(86) PCT No.: PCT/US2012/065535

§ 371 (c)(1),
(2) Date: May 7, 2015

(87) PCT Pub. No.: WO2014/077834

PCT Pub. Date: May 22, 2014

(65) Prior Publication Data

US 2015/0282591 A1 Oct. 8, 2015

(51) Int. Cl.
*A45D 40/04* (2006.01)
*A45D 40/20* (2006.01)
(Continued)

(52) U.S. Cl.
CPC ..... *A45D 40/04* (2013.01); *A45D 40/14* (2013.01); *A45D 40/205* (2013.01); *A45D 2040/0025* (2013.01); *A45D 2040/0062* (2013.01); *A45D 2040/208* (2013.01)

(58) Field of Classification Search
CPC ..... A45D 40/04; A45D 40/205; A45D 2040/208; A45D 2040/0025
USPC ..... 401/68, 75, 172, 194
See application file for complete search history.

(56) References Cited

U.S. PATENT DOCUMENTS 2,284,218 A * 5/1942 Livingston ..... B65D 83/011 116/327
3,078,011 A 2/1963 Safianoff
(Continued)

FOREIGN PATENT DOCUMENTS

FR 2833816 6/2003
JP H11-225823 8/1999
(Continued)

OTHER PUBLICATIONS

International Search Report and the Written Opinion issued in International Application PCT/US2012/065535 mailed Jul. 25, 2013.

*Primary Examiner* — Jennifer C Chiang

(57) ABSTRACT

A stick product dispensing system is disclosed which prospectively provides an advance or early warning to a user that the product will soon be depleted. In one embodiment, the product dispensing system includes a dispenser (10) having a tubular barrel (20) with an open end (24), a solid stick product (12) disposed in the barrel (20), and a moveable platform (40) disposed in the barrel (20) for supporting and dispensing the product (12) through the open end (24). The platform (40) includes a plurality of spaced apart indicator protrusions (100) extending outwards from the platform (40) forming interstitial spaces holding a reserve amount of product. After repeated uses of the dispenser, the protrusions (100) eventually emerge from the top of the stick product (12) signaling the user that one or a few additional applications remain. This allows the user to purchase another dispenser in advance to avoid running out of product. In one embodiment, the product may be a deodorant/anti-perspirant.

28 Claims, 9 Drawing Sheets

(51) Int. Cl.
*A45D 40/14* (2006.01)
*A45D 40/00* (2006.01)

(56) References Cited

U.S. PATENT DOCUMENTS

| | | | | | |
|---|---|---|---|---|---|
| 3,185,345 | A | | 5/1965 | Hunegs | |
| 4,595,124 | A | * | 6/1986 | Duval | B65D 83/0011 222/39 |
| 4,702,399 | A | | 10/1987 | Davis | |
| 4,782,983 | A | * | 11/1988 | Cook | B65D 83/0005 116/307 |
| 5,000,356 | A | * | 3/1991 | Johnson | A45D 40/04 222/340 |
| 5,088,623 | A | | 2/1992 | Crawford | |
| 5,137,185 | A | | 8/1992 | Mitchell | |
| 5,150,978 | A | | 9/1992 | Stewart et al. | |
| 5,152,427 | A | | 10/1992 | Pope et al. | |
| 5,401,112 | A | | 3/1995 | Dornbusch et al. | |
| 5,538,161 | A | * | 7/1996 | Koehler | A45D 40/04 116/200 |
| 5,735,212 | A | | 4/1998 | Oyaizu | |
| 5,897,263 | A | | 4/1999 | Fattori | |
| 5,961,007 | A | | 10/1999 | Dornbusch et al. | |
| 5,997,202 | A | | 12/1999 | Durocher | |
| 6,129,472 | A | | 10/2000 | Thayer | |
| 7,621,462 | B2 | | 11/2009 | Faires | |
| 2012/0043695 | A1 | | 2/2012 | Yuhas | |

FOREIGN PATENT DOCUMENTS

| | | |
|---|---|---|
| JP | 2007 209694 | 8/2007 |
| WO | WO 96/16569 | 6/1996 |
| WO | WO 02/24024 | 3/2002 |

* cited by examiner

STICK PRODUCT DISPENSING SYSTEM

CROSS-REFERENCE TO RELATED PATENT APPLICATIONS

This application is a U.S. national stage application under 35 U.S.C. §371 of PCT Application No. PCT/US2012/65535, filed Nov. 16, 2012, the entirety of which is incorporated herein by reference.

FIELD OF THE INVENTION

The present invention relates to dispensers for cosmetic or other products, and more particularly to a dispensing system for solid stick products including early warning of impending product depletion to a user.

BACKGROUND OF THE INVENTION

Solid stick cosmetic and other personal care products are packaged in containers or dispensers which include a mechanism for advancing and distending the product for application by the user. Such products may include without limitation deodorants and antiperspirants ("deodorant/antiperspirant" hereafter). Such dispensers are generally made of an opaque material and covered by the manufacturer's product labels. Accordingly, as the stick product is applied and consumed, the user generally does not have any indication of how much product is left after each use. The user may run out of product on the next application leaving no time to plan in advance for purchasing an additional dispenser when convenient.

An improved solid stick product dispenser is desired.

BRIEF SUMMARY OF THE INVENTION

A stick product dispensing system is disclosed having an automatic early warning system to alert a user in advance of the impending depletion of the stick product, thereby advantageously permitting the user to purchase a replacement product when convenient before it is actually needed. The early warning system in some embodiments provides both visual and tactile indication to the user.

According to one embodiment, the invention can be a dispensing system for dispensing a solid stick product comprising: a dispenser having a tubular barrel with an open end and defining an axial centerline; a solid stick product disposed m the tubular barrel a moveable platform disposed in the barrel and supporting the solid stick product; an actuator mechanism operable to move the moveable platform axially in the tubular barrel towards the open end for dispensing the solid stick product; and a plurality of spaced apart indicator protrusions extending axially outwards from the moveable platform, the plurality of spaced apart protrusions being embedded in the solid stick product and forming interstitial recesses holding, a reserve volume of the solid stick product; wherein after repeated applications of the solid stick product by the user, the solid stick product abrades away and the plurality of spaced apart indicator protrusions become exposed to provide a tactile and visual indication that the solid stick product is near depletion.

In another embodiment, a dispensing system for dispensing a solid stick product includes a dispenser including a tubular barrel defining an axial centerline and having an open end, the barrel having a transverse cross-sectional profile, a solid stick product disposed in the barrel wherein the stick product is self supporting when removed from the barrel of the dispenser, a moveable platform slidably disposed in the barrel and supporting the stick product, an actuator mechanism comprising an elevator screw threadably coupled to the platform and a knob connected to the screw, the actuator mechanism being operable to move the platform axially in the barrel towards the open end of the barrel for dispensing the stick product by rotating the knob, and a plurality of spaced apart indicator protrusions extending axially outwards from the platform. The indicator protrusions are embedded in the stick product and form interstitial recesses holding a reserve volume of the stick product. After repeated applications of the stick product by the user, the stick product gradually abrades away and the indicator protrusions become exposed to provide a tactile and visual indication that the stick product will soon be depleted.

An exemplary method for indicating impending depletion of a solid stick product from a dispenser is also provided. In one embodiment, the method includes the steps of providing a dispenser including a solid stick product disposed in an axially extending barrel having a completely open end, a moveable platform slidably disposed in the barrel and supporting the stick product, and an actuator mechanism operable to move the platform axially towards the open end of the barrel for dispensing the stick product; a user repeatedly projecting the stick product outwards from the dispenser using the actuator mechanism to expose a portion of the stick product; the user repeatedly applying the exposed portion of stick product to their body by rubbing the exposed portion against their skin; repeatedly abrading away the exposed portion of the stick product with each application; directly engaging a plurality of exposed indicator protrusions embedded in the exposed portion of the stick product with the skin of a user; the user applying the exposed portion of stick product with exposed indicator protrusions embedded therein to their body at least one additional time by rubbing the exposed portion and indicators protrusions against their skin; and the user applying a reserve volume of stick product stored in interstitial recesses formed between the indicator protrusions to their body. In one embodiment, the indicator protrusions extend above the top end of the dispenser barrel when the indicator protrusions are exposed to facilitate contact with the user's skin upon application of the stick product.

In still another embodiment, the invention can be a dispenser for a solid stick product comprising: a tubular barrel having an open end, the solid stick product disposed in the tubular barrel; a moveable platform disposed in the barrel, the moveable platform having a top surface supporting the solid stick product; an actuator mechanism operable to move the moveable platform in the tubular barrel to dispense the solid stick product through the open end; and at least one indicator protrusion extending from the top surface of the moveable platform, the at least one protrusion being embedded in the stick product; wherein after repeated applications of the solid stick product by the user, the solid stick product abrades away and the at least one indicator protrusion becomes exposed to provide an indication that the stick product is near depletion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of invention.

BRIEF DESCRIPTION OF THE DRAWINGS

The present invention will become more fully understood from the detailed description and the accompanying drawings, wherein.

Figure 1:
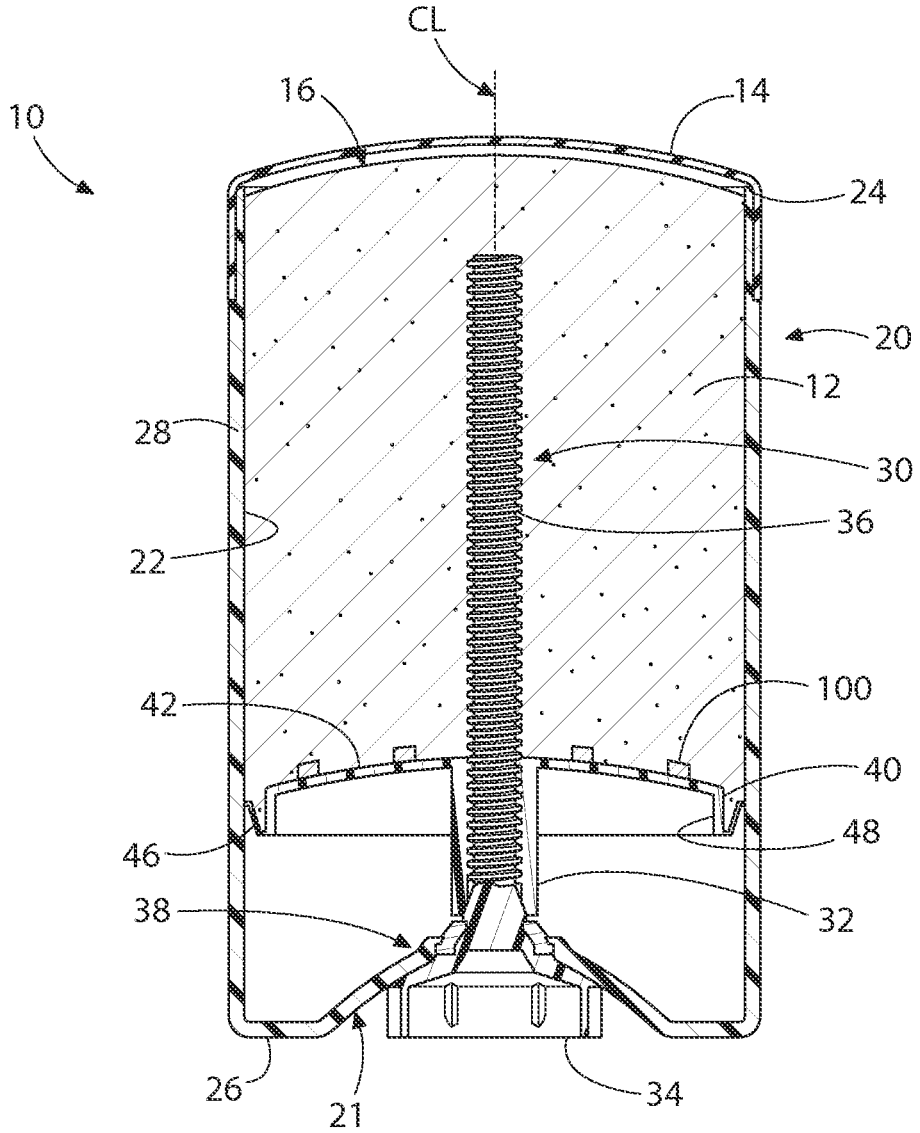
FIG. 1 is a side elevation view of an embodiment of a solid stick product dispensing system in a first operating position.

All drawings are schematic and not actual physical representations of the articles, components or systems described herein, and are further not drawn to scale. The drawings should be interpreted accordingly.

DETAILED DESCRIPTION OF THE INVENTION

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
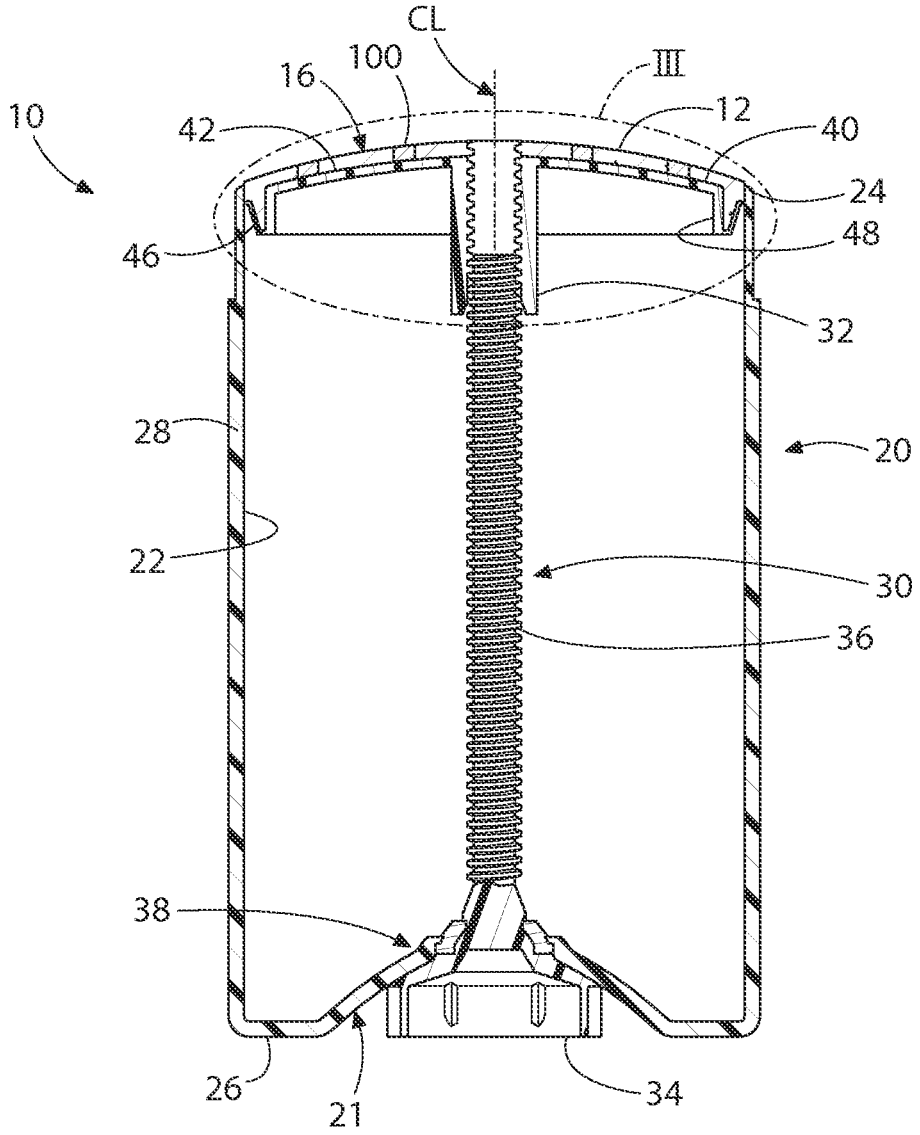
FIG. 2 is a side elevation view of the embodiment of FIG. 1 shown in a second operating position.
Figure 3:
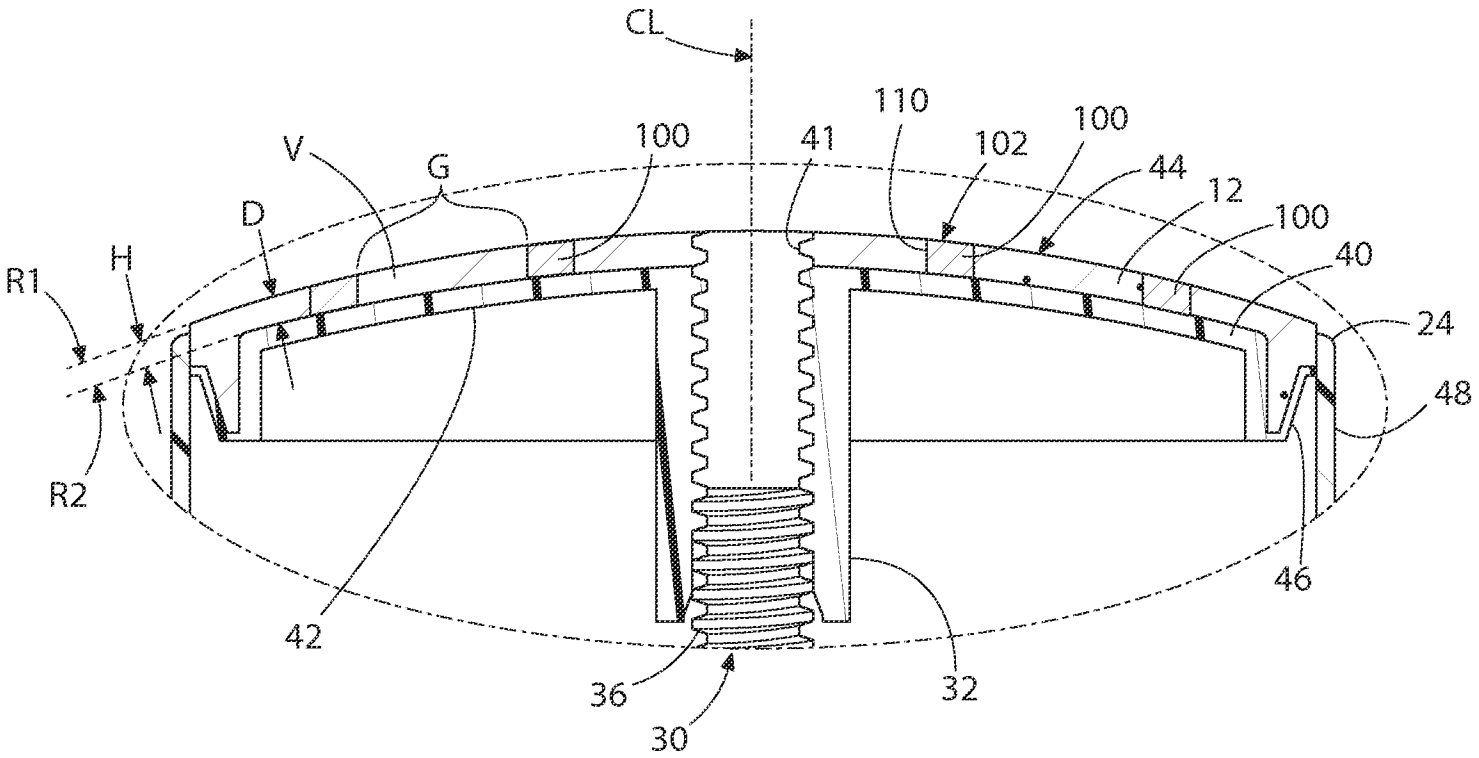
FIG. 3 is a partial side elevation cross-sectional view of the top portion of the dispenser shown in FIG. 2 showing with indicator protrusions.

FIGS. 1-3 depicts an exemplary dispenser 10 for storing and dispensing a solid stick product 12, which in some embodiment may be a personal care or cosmetic product such as without limitation a deodorant/anti-perspirant. As defined herein, a solid stick product shall mean any product that is in a solidified form at ambient room temperatures and which is self-supporting and maintains its shape outside of the dispenser.

Dispenser 10 includes a tubular barrel 20 defining an internal cavity 22 therein for storing the solid stick product 12. Barrel 20 includes a top end 24, bottom 26, and sidewalls 28 extending vertically and axially therebetween. Top end 24 is open in an embodiment for dispensing stick product to a user therethrough. Bottom end 26 may be substantially or fully closed and includes a bottom or lower wall 21 in an embodiment as shown. A removable storage cap 14 configured to fit onto top end 24 of barrel 20 may be provided.

Barrel 20 further defines an axial centerline extending between the ends 24, 26. In various embodiments, barrel 20 may have an oval or elliptical cross-sectional profile when view in a transverse direction to the centerline CL. Other suitable cross-sectional profiles may be provided including circular, rectilinear and polygonal shapes. Accordingly, the invention is not limited to a barrel 20 of any particular cross-sectional profile.

In some embodiments, barrel 20 may be formed of a semi-rigid or rigid plastic material such as without limitation polypropylene or polyethylene. However, it will be appreciated that other suitable commercially-available plastic material may be used which are appropriate for a product dispenser.

With continuing reference to FIGS. 1-3, dispenser 10 further includes a moveable product support platform 40 including a horizontal wall 42 oriented substantially transversely to centerline CL of the dispenser 10 and vertically extending side flange 48 depending axially downwards from wall 42. Flange 48 is disposed proximate to sidewalls 28 of barrel 20. In some embodiments, as shown, a flexible seal 46 may be provided around the perimeter of flange 48 which slidably engages and seals against sidewalls 28 of barrel 20 for forming a seal between regions of internal cavity 22 above and below the platform 40. In other embodiments, no seal is provided.

In some embodiments, product support platform 40 may be formed of a semi-rigid or rigid plastic material which is not substantially deformable or resilient, such as without limitation polypropylene or polyethylene. Other suitable commercially-available plastic material may be used which are appropriate for a product dispenser.

Referring to FIGS. 1-3, dispenser 10 further includes an actuator mechanism operable for raising platform 40 in and with respect to barrel 20. In one embodiment, the actuator mechanism is comprised of an elevator screw 30 having an externally partially or fully threaded shaft 36 which engages a complementary internally threaded sleeve 32 formed integral with or attached to platform 40. Sleeve 32 and shaft 30 may be aligned substantially along and parallel to axial centerline CL of barrel 20. A lower end of elevator screw shaft 36 includes an operator which in some embodiments may be in the form of an actuator knob 34 that is turnable or rotatable by a user to dispense the stick product 12. Actuator knob 34 is rigidly connected to elevator screw shaft 36 so that turning or rotating the knob concomitantly causes shaft 36 to rotate. As best shown in FIG. 3, support platform 40 includes a centrally located axial threaded or unthreaded aperture 41 which allows elevator screw 30 to pass therethrough during operation of the actuator mechanism (see also FIG. 1).

Barrel 20 is configured to rotatably support actuator knob 34 and shaft 36 such as via a mounting portion 38 disposed in a bottom wall 21 formed on bottom 26 of the barrel that is coupled to the knob-shaft assembly as shown. Mounting portion 38 is configured to allow the knob-shaft assembly 34/36 to rotate, but to prevent this assembly from moving axially upwards in barrel 20 as the knob and shaft are rotated, thereby maintaining a stationary position of the knob-shaft assembly relative to sidewalls 28 of the barrel. Support platform 40 is non-rotatable with respect to barrel 20 of dispenser 10 in certain embodiments.

Support platform 40 includes an upward facing top support surface 44 for supporting stick product 12 as best shown in FIG. 3. This support surface 44 is defined by horizontal wall 42 in one embodiment. Surface 44 may have various side cross-sectional shapes as viewed perpendicular or transverse to axial centerline CL of dispenser 10, including flat/planar, and arcuately curved shapes including convex (as shown) or concave (not shown). Convexly curved surfaces 44 may be provided to conform to the contour of the portion of a user's body to which the stick product will be applied particularly in the case of underarm deodorants/antiperspirants.

Stick product 12 may substantially completely fill internal cavity 22 in the some embodiments, and thereby directly contact support surface 44 of platform 40 and the sidewalls 28 of barrel 20. During the manufacturing and dispenser filling process, the stick product may be introduced through open top end 24 of dispenser 10 into barrel 20 in a viscous, at least partially liquefied state produced by heating the product to a temperature elevated above normal ambient room temperatures and the temperature at which the product is in solid state. The product will fill the internal cavity 22 along the sidewalls 28 of barrel 20 and onto upward facing top support surface 44 of platform 40, which in essence defines an axially moveable bottom wall. Seal 46 prevents leakage of the liquefied stick product beneath platform 40. The product 12 is then allowed to cool and solidifies/hardens thereby transforming the product into a solidified state or stick product form ready to be dispensed by a user.

In operating the dispenser actuator mechanism to dispense the solidified stick product, a user rotates actuator knob 34 a first direction which connected to elevator screw 30 and threadably engaged with sleeve 32 fixedly coupled to platform 40. Platform 40 axially and gradually moves upwards in barrel 20 via operation of the elevator screw 30 which turns rotary motion of the screw and knob 34 in axial motion of the platform. This in turn slidably moves and raises the stick product 12 within barrel 20 upwards thereby projecting a top surface 16 and adjacent upper portions of the product outwards through and beyond the open top end 24 of the barrel. With a solid stick product, the top surface 16 forms the applicator surface that directly contacts a user's skin without any intervening structures in contrast to dispensers which contain a viscous flowable product at ambient room temperature such as a cream or paste that necessarily have an applicator with a plurality of openings through which the product is extruded and dispensed. In some embodiments, the solid stick product 12 may be retracted back within barrel 20 by rotating knob 34 in an opposite second direction. It should be noted that the portion of hardened stick product 12 extending beyond the top end 24 of band 20 is self-supporting and maintains its shape in contrast to some viscous partially solid products which do not hold their shape outside of the dispenser. If fully removed from dispenser 10, stick product 12 has a cross-sectional transverse profile that substantially conforms to the cross-sectional profile of dispenser barrel 20 due to its self-supporting solidified state.

In some embodiments, the platform 40 may not be movable. In other embodiments, the elevator screw 30 and the threaded shaft 36 are eliminated from the actuator mechanism. In these alternative embodiments, the elevator screw 30 and the shaft 36 may be replaced with other components that allows the advancement of the platform 40 toward the dispensing end of the barrel 20 via manual force. It is also contemplated that in these alternative embodiments, no additional components is necessary for advancing the platform 40.

The user may then apply the stick product 12 as desired. In the case where the stick product is a deodorant/antiperspirant product, the user typically presses the product against their in and using a wiping motion across the body to apply the product. This abrades away and deposits a portion of the stick product 12 including the existing top surface 16 onto the skin of the user. The top surface 16 of stick product 12 continually changes and is renewed as a new top portion of the product is exposed after each application by the user until the supply of product provided in dispenser 10 is depleted. Accordingly, a predetermined volumetric amount of stick product 12 is dispensed and consumed with each application by a user. Manufacturers of stick products can readily determine how much product is normally dispensed and consumed by the user with each typical application of the product, thereby allowing a predetermined average per usage volume of product to be calculated. This allows manufacturers to determine how long a known amount of stick product 12 packaged in a stick product dispenser 10 will last a user.

According to one aspect of the present disclosure, an automatic early warning system is provided which alerts a user of the impending depletion of the stick product 12, thereby advantageously permitting the user to purchase a replacement product when convenient before it is actually needed. The early warning system provides both visual and tactile indication to the user. In one embodiment, a reserve volume of stick product 12 is provided after the early warning system first provides an indication to the user that the product is almost, but not completely depleted.

In one embodiment shown in FIGS. 1-3, the product depletion early warning system generally includes at least one or more protuberances or protrusions 100 formed on product support platform 40. The indicator protrusions 100 extend upwards axially from and are raised above support platform 40. The protrusions 100 each define an upper indicator surface 102 as best shown in FIG. 3. Accordingly, indicator protrusions 100 create a configuration on support platform 20 facing stick product 12 having a combination of raised surface areas formed by upper indicator surfaces 102 and recessed surface areas on platform 40 between the protrusions and spaced below the indicator surfaces.

Upper indicator surfaces 102 of indicator protrusions 100 are configured and dimensioned to provide both a visual indicator and to contact the skin of a user when the stick product 12 is applied, thereby signaling the presence of the indicator protrusions 100 to the user both tactilely and visually. This provides an advance or early indication that the stick product 12 is almost completely consumed or depleted. Indicator surface 102 may have any suitable cross-sectional shape when viewed perpendicular or transverse to the axial centerline CL of dispenser 10 (see, e.g. FIG. 3), such as without limitation planar/flat or curved including convex or concave shapes and others. Accordingly, indicator surface 102 is not limited to any particular shape.

Figure 6:
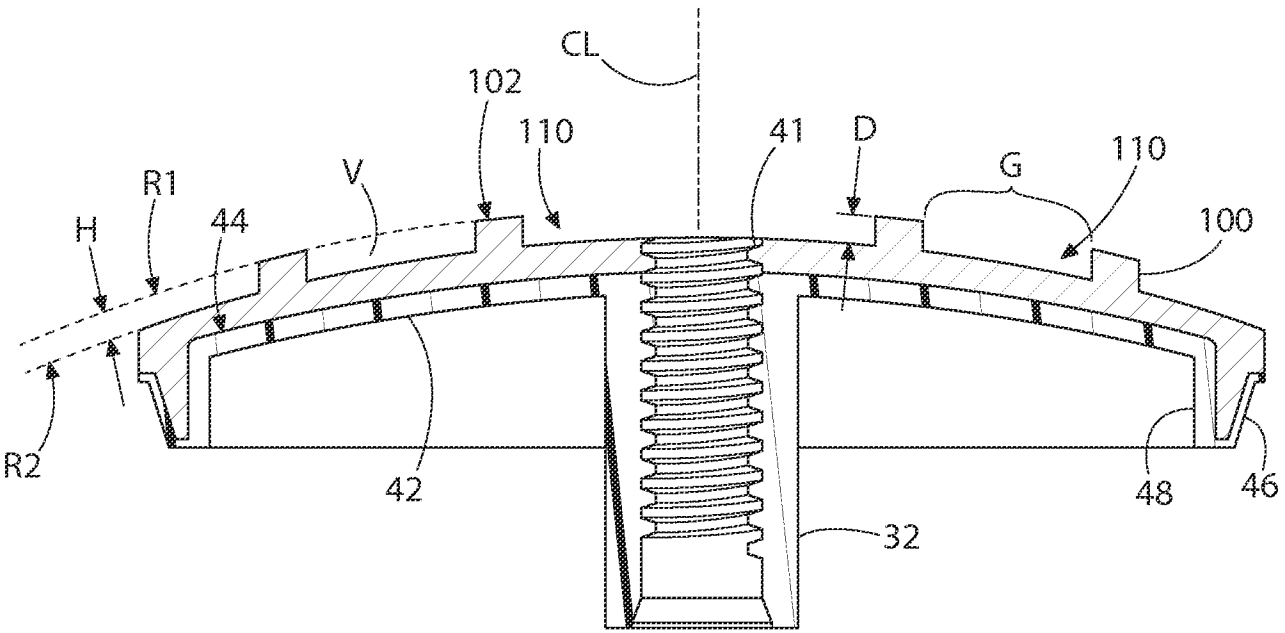
FIG. 6 is a partial side elevation cross-sectional view of the top portion of the dispenser shown in FIG. 2 showing product support platform in greater detail with a first alternative construction of indicator protrusions.
Figure 7:
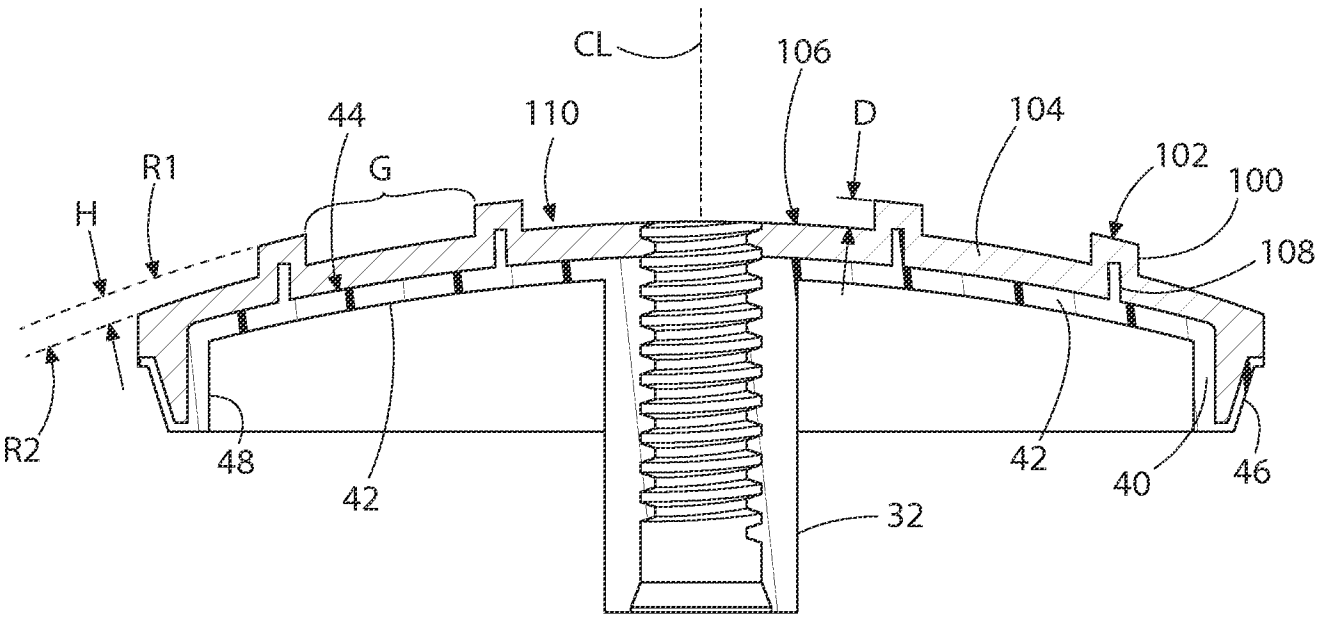
FIG. 7 is a partial side elevation cross-sectional view of the top portion of the dispenser shown in FIG. 2 showing product support platform in greater detail with a second alternative construction of indicator protrusions.

In one embodiment, indicator protrusions 100 collectively have a combined total surface area defined by the upper indicator surfaces 102 that is less than the total horizontal surface area of the platform top support surface 44. Accordingly, indicator protrusions 100 are laterally spaced apart transverse to the axial centerline CL of dispenser 10 thereby forming interstitial spaces or gaps G between the protrusions for receiving and holding a residual or reserve volume V of solid stick product (see, e.g. FIGS. 3 and 6-7), as further explained herein. These spaces or gaps G form a plurality of variously shaped interstitial recesses 110 configured and dimensioned to hold the reserve volume V of stick product 12 for providing a user with extra spare applications of the stick product once the product depletion early warning system is activated. Recesses 110 have a depth D for holding reserve stick product 12 that corresponds to the height H of indicator protrusions 100 as shown in FIGS. 3 and 6-7. FIGS. 6 and 7 show product support platform 40 without stick product 12 present in recesses 110. FIG. 3 shows the stick product in place in recesses 110.

In some embodiments, indicator protrusions 100 may each have an individual lower base portion 104 that is disposed directly onto top support surface 44 of platform 40 and secures the indicator protrusions 100 to platform 40 (see, e.g. FIG. 3). In this construction, top support surface 44 of platform 40 between indicator protrusions 100 defines a bottom extent or end surface of the solid stick product 12. Top support surface 44 of platform 40 is therefore exposed between the indicator protrusions 100 so that the stick product 12 fills the interstitial gaps G between the indicator protrusions 100 and rests directly on top support surface 44 when the dispenser 10 is initially filled with the product in a flowable liquid form.

An alternative indicator protrusion 100 construction may be provided in which each or a predetermined group of protrusions may each share a common base portion 104 that is disposed on top support surface 44 of platform 40. In one embodiment, the common base portion 104 may completely cover the platform top support surface 44 (see, e.g. FIG. 6). In this construction, the top surface 106 of the common base portion 104 between indicator protrusions 100 defines a bottom extent or end surface of the solid stick product 12.

In one alternative variation of the foregoing construction, the top surface 44 of platform 40 may include a plurality of anchors 108 for further securing the base portion 104 of indicator protrusions 100 to the platform, as shown in FIG. 7. Anchors 108 extend axially outwards from top surface 44 of the platform 40 and may have any suitable shape. The base portions 104 of the indicator protrusions 100 are formed or molded around anchors 108 thereby advantageously enhancing the strength of the attachment between the protrusions and platform. Anchors 108 may be formed integrally with platform 40 as part of a unitary structure or may be discrete separate components attached to the platform. Anchors 108 may be used in various constructions including indicator protrusions 100 sharing a common base portion 104 as shown in FIG. 7 or when each indicator protrusion has its own individual base portion attached to platform 40 (see, e.g. FIG. 3—anchors not shown).

In other possible embodiments, two or more spaced apart and/or adjoining common base portions 104 may be provided and arranged on platform top support surface 44 with exposed portions of the top support surface 44 being created between the common base portions. This would create a combination or hybrid construction combining features of FIGS. 3 and 6. In this construction, a combination of the top surface 106 of the common base portion 104 and top support surface 44 of platform 40 between the indicator protrusions 100 defines a bottom extent or end surface of the solid stick product 12.

It should be noted that any of the foregoing base portion 104 constructions for indicator protrusions 100 may be used without detriment. The choice of which base portion constructions to be used will depend on the number, size, pattern, configuration, and arrangement of indicator protrusions 100 to be provided as well fabrication considerations such as production cost and efficiency.

Indicator protrusions 100 may be formed of the same or a different material than top platform 40. In one embodiment, indicator protrusions 100 can be formed a material that is different and more resiliently deformable than platform 40 to allow a user to access a stick product 12 reserve disposed between indicator protrusions 100. Accordingly, platform 40 may have a higher Shore A hardness than indicator protrusions 100. In one exemplary embodiment, without limitation, indicator protrusions 100 are made of an elastomeric material that is deformable. Preferably, indicator protrusions 100 are soft in tactile feel so as to not unduly irritate a user when the contact is made with the user's skin. Suitable elastomers include without limitation a thermoplastic vulcanate (TPV) consisting of at mixture of polypropylene and EPDM (ethylene propylene diene monomers) which is available as SANTOPRENE (brand), described in U.S. Pat. No. 5,393,796, or VYRAM (brand), another TPV consisting of a mixture of polypropylene and natural rubber. Both SANTOPRENE and VYRAM (brands) are elastomers marketed by Advanced Elastomer Systems. Other suitable elastomers include KRATON, a brand of styrene block copolymer (SBC) marketed by Shell, and DYNAFLEX G 2706 (brand), a thermoplastic elastomer marketed by GLS Corporation and which is made with KRATON (brand) polymer.

Lower base portions 104 of indicator protrusions 100 may be secured to platform 40 by overmolding wherein the platform and protrusions are molded as one integral unitary structure, using a two-component injection molding operation similar to that used in the manufacture of toothbrushes. This process may be used whether individual base portions 104 of each indicator protrusion 100 (see, e.g., FIG. 3) or a common base portion 104 (see, e.g., FIGS. 6 and 7) are provided. In some embodiments, the protrusions may be molded as a portion of the platform. In other embodiments, the protrusions may be attached to the platform by any suitable mechanical means.

Referring to FIG. 3, the upper indicator surface 102 of at least one or more indicator protrusions 100 collectively define an imaginary reference plane R1 which is spaced axially and vertically apart from top support surface 44 of platform 40 which defines a second imaginary reference plane R2. Accordingly, reference planes R1 and R2 generally follow the side elevation contour of indicator protrusions 100 and top support surface 44 of platform 40, respectively. Interstitial gaps G formed laterally between the protrusions 100 and the head space defined by the height H of the protrusions measured between reference planes R1 and R2 define a residual or reserve volume V of solid stick product which remains for use when the upper indicator surfaces 102 first become exposed (compare with FIG. 1 showing upper indicator surfaces 102 completely embedded within the stick product). At this juncture, the user is alerted that the product 12 is almost depleted.

It should be noted that a single indicator protrusion 100 may be considered to define reference plane R1 and respectively interstitial gaps G and recesses 110 between the top indicator surface 102 of the indicator protrusion and adjacent lower reference plane R2 defined by surface 44 on platform 40, which defines reserve volume V of stick product 12. Such is the case of an indicator protrusion 100 in the form a single raised rod or peg. It will further be appreciated that some compound shaped individual indicator protrusions 100 might be considered a single continuous indicator structure in top plan view (e.g. a letter "O" or circle with open center) that define recesses 110 both internally within the structure itself and also in those adjacent portions of dispenser 10 located above platform 40 lying outside of the perimeter of the indicator protrusion between imaginary reference planes R1 and R2. Accordingly, embodiments of the present disclosure expressly include indicator protrusions 100 covering either of the foregoing possible structures and arrangements.

In some embodiments, the predetermined reserve volume V of stick product 12 remaining when indicator surfaces 102 first become exposed may be designed to provide about 1-2 or more additional applications for the user before being fully consumed. Accordingly, the reserve volume V of stick product to be provided in some embodiments may equal "X" times a predetermined average per usage volume of the solid stick product, wherein X is greater than or equal to 1.

Embodiments of dispenser 10 may further includes indicia that communicates or relays to the user that approximately X number of uses of the solid stick product remain upon initial exposure of the indicator protrusions 100. Such indicia may include any type and number of alphabetical and numerical indicia that may be emplaced directly on the dispenser 10 or cap 14, and/or on labels adhered to the dispenser or cap. In some embodiments, the indicia may be the protrusions.

Operation of the product depletion early warning system which prospectively alerts a user that the stick product 12 will soon be depleted will now be described. In this example, for convenience, the stick product will be assumed to be a deodorant/antiperspirant. However, other types of solid stick product may be dispensed with equal benefit from the early warning system disclosed herein.

FIG. 1 shows a new unused stick product dispenser 10 in a condition as initially purchased having a full charge of stick product 12. The removable storage cap 14 is shown in position on barrel 20 and closes normally open top end 24 of the product dispenser. Platform 40 is in an initial first lower position with respect to barrel 20 being disposed at a position in the lower half of dispenser 10. Top surface 16 of stick product 12 is substantially at the same elevation as top end 24 of dispenser 10 and does not substantially extend beyond the end of the dispenser. Indicator protrusions 100 including top surfaces 102 are fully embedded in stick product 12 well beneath the top surface 16 of the product.

Figure 5:
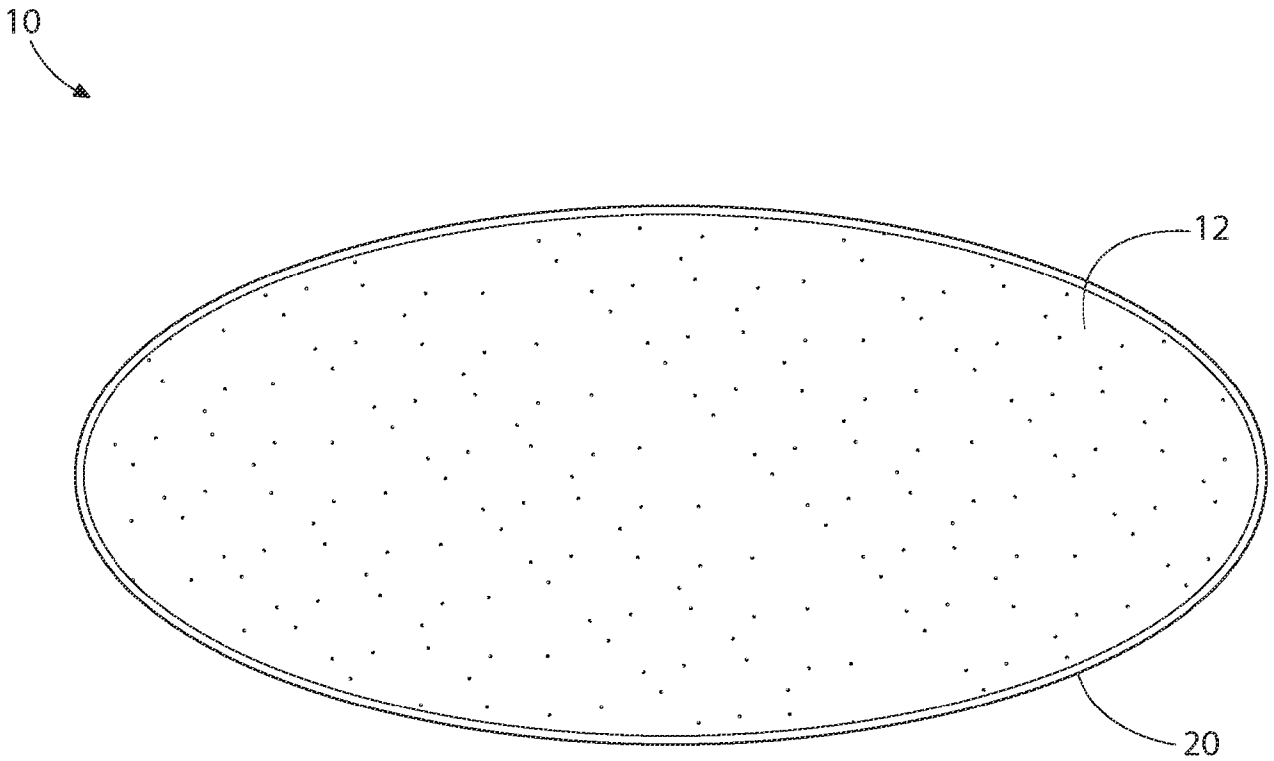
FIG. 5 is a top plan view of the stick product of FIG. 1 in which the indicator protrusions have not yet emerged from the stick product.

To apply the stick product 12 to their body, the user first rotates knob 34 which simultaneously rotates elevator screw 30. This raises platform 40 axially upwards towards open top end 24 of dispenser 10 which slidably moves or pushes stick product 12 upwards in turn The top surface 16 and an adjacent portion of stick product 12 are projected outwards from and beyond top end 24 of the dispenser. It should be noted that the entire top surface 16 area of stick product 12 extends beyond top end 24 of dispenser barrel 24 and is available for application to the user's skin, as shown in the top plan view of FIG. 5 corresponding to a plan view of stick product 12 as seen in FIG. 1 of a new product dispenser 10.

Next, the user rubs the exposed stick product 12 across their skin to remove and apply a portion of the product via an abrading action which deposits a portion of the product on the user's body. With each application, the top surface 16 of the product 12 is renewed by exposing a new portion of the product after the previous surface or layer is abraded away. This cycle is repeated numerous tunes with each application of the stick product 12.

Over time, the stick product 12 is consumed and gradually is abraded away nearing depletion to a point where no useable amount of product will remain for application. Support. platform 40 gradually moves upwards and advances in axial position in band 20 of dispenser 10 with each application as seen by comparing FIGS. 1 and 2. As best shown in FIG. 3, there is very little stick product 12 remaining. Eventually, as shown in FIGS. 2 and 3, product support platform 40 reaches an uppermost axial position at or near the top end 24 of dispenser 10. In this final position, the platform 40 cannot be advanced any farther with respect to barrel 20 of dispenser 10. With each use of the dispenser 10, the upper indicator surfaces 102 of each indicator protrusion 100 also gradually move closer and close to the top surface 16 of the stick product.

As best shown in FIG. 3, which is a closeup detailed view taken from FIG. 2, the upper indicator surface 102 of each indicator protrusion 100 ultimately emerges from beneath the top surface 16 of stick product 12 and becomes exposed. When this occurs, the user is presented with a visual indicator that the stick product is almost depleted if the user is observant. The indicator protrusions 100 extend beyond the top end 24 of dispenser barrel 20 as shown so that the protrusions are also further positioned to tactilely engage the skin of the user when the user applies the stick product in case the user has not noticed the exposed indicator protrusions. As the users rubs the stick product across their skin during application, they are also provided with a tactile indication since the indicator protrusions 100 when the user feels the protrusions. If indicator protrusions 100 are formed of a resilient flexible elastomeric material in some embodiments which may generally be selected to have a greater coefficient of friction than the adjacent stick product, the user will feel a noticeable difference between the relatively smooth feel when the stick product alone is dragged across the skin in contrast to the elastomeric indicator protrusions. The indicator protrusions 100 will slightly grab the user's skin so that the user does not experience the same smooth feeling as with all stick product alone, thereby tactilely alerting the user to the presence of the indicator protrusions and impending depletion of the stick product 12. According to the present disclosure therefore, the indicator protrusions 100 are configured and arranged to directly engage the skin of a user for providing a tactile indication of the impending depletion of stick product.

The user may now plan to purchase a new stick product dispenser, but advantageously is provided with a reserve volume V of product providing some lead time to acquire the new dispenser.

It should be noted that resiliently flexible and deformable elastomeric indicator protrusions 100 advantageously allow the user to readily access the reserve volume V of stick product 12 (reference FIG. 3) for extending the use of the dispenser. The flexible elastomeric indicator protrusions 100 advantageously deform and bend laterally/sideways in a direction transverse to the axial centerline CL of dispenser 10 when pressed against the user's skin, thereby exposing and allowing the user to gain access to the reserve volume V of stick product 12 which can be readily deposited on the user's body.

Figure 15:
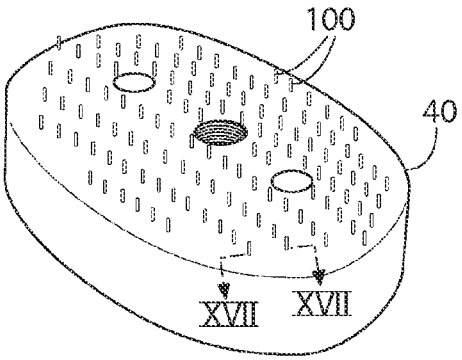
FIGS. 15 and 16 are perspective and top plan views of the product support platform showing an arrangement of indicator protrusions in the form of elongated bristles.
Figure 16:
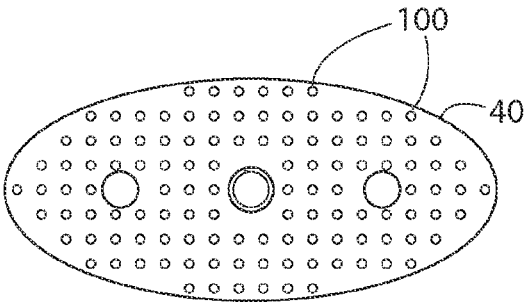
Figure 17:
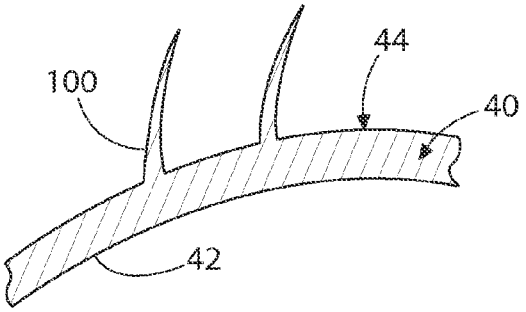
FIG. 17 is a detailed cross-sectional side view of a portion of the support platform taken along lines XVII-XVII in FIG. 15 showing the bristles in greater detail.

In certain embodiments, the indicator protrusions 100 may be formed of the same material and fabricated integrally with support platform 40 as an integral unitary structure (see, e.g. FIGS. 15-17).

Indicator protrusions 100 may be provided in an enumerable variety of configurations and arrangements. In addition, indicator protrusions 100 may be provided in a different or contrasting color than the solid stick product in which they are embedded to enhance the user's visual perception of the indicator protrusions when they first become exposed and emerge from the stick product 12 during an application or use.

Figure 4:
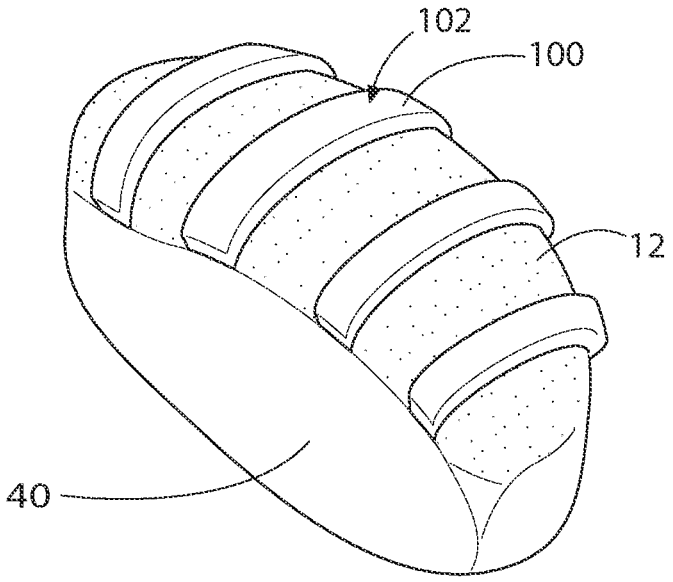
FIG. 4 is a perspective view of the stick product and early warning product depletion indicator protrusions of FIG. 3 disembodied from the dispenser for clarity.
Figure 11:
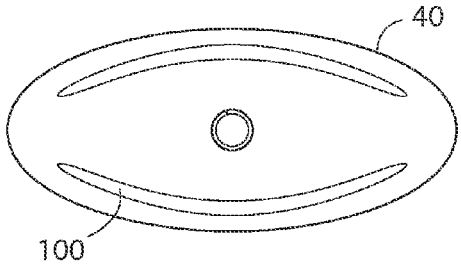
FIGS. 11 and 12 are a top plan and perspective views of the product support platform showing an arrangement of indicator protrusions in the form of arcuately curved elongated bars.
Figure 12:
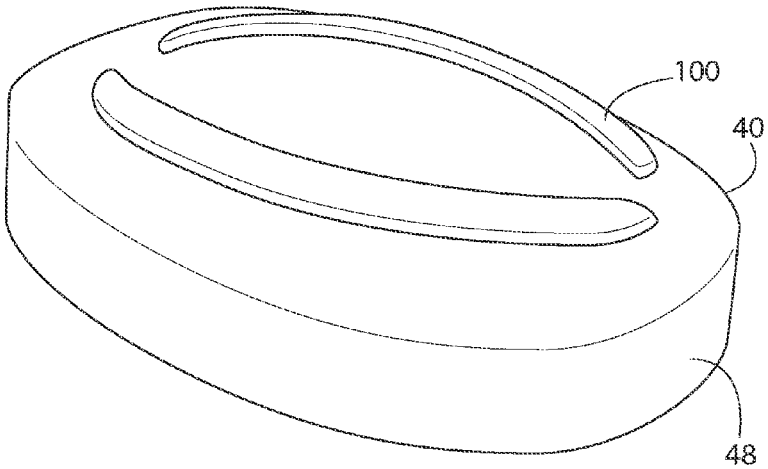
Figure 13:
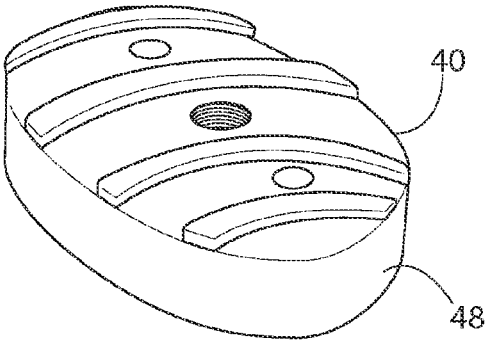
FIGS. 13 and 14 are perspective and top plan views of the product support platform showing an arrangement of indicator protrusions in the form of elongated bars in a diagonal pattern.
Figure 14:
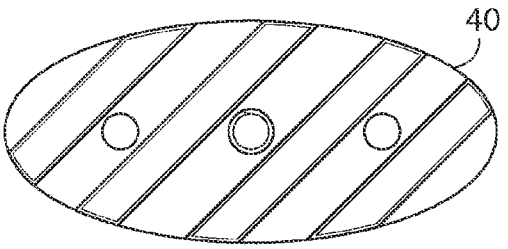

FIG. 4 shows an embodiment of indicator protrusions 100 in the form of parallel spaced elongated raised bars. The bar-shaped protrusions may be oriented and arranged to extend laterally parallel to the minor axis (or conjugate diameter) of the ellipsoidal shaped solid stick product 12 as shown. In other embodiments, the bar-shaped protrusions may be oriented parallel to the major axis (or transverse diameter) of the stick product (not shown). In another possible embodiment, the bar-shaped protrusions may be arranged diagonally to both the major and minor axes as shown in FIG. 14. The bar-shaped protrusions may also be arcuately curved and arranged, and in some embodiments may follow and complement the perimeter of stick product 12 (in top plan view) as shown in FIGS. 11 and 12. A combination of any of these three foregoing possible arrangements of bar-shaped indicator protrusions 100 may also be provided.

Figure 9:
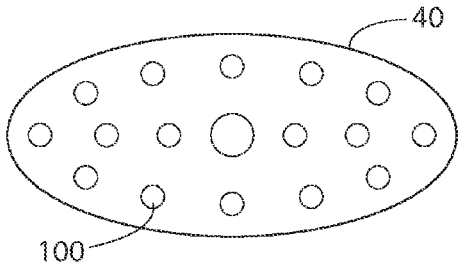
FIGS. 9 and 10 are top plan views of the product support platform showing an arrangement of indicator protrusions in the form of round rods or pegs of different patterns and sizes.
Figure 10:
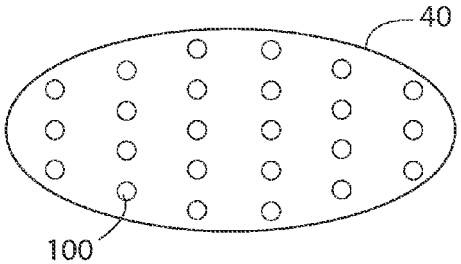

FIGS. 9 and 10 show two possible embodiments of indicator protrusions 100 in the form of raised spaced part round rods or pegs (in top plan view).

FIGS. 15-17 show possible embodiments of indicator protrusions 100 in the form of axially elongated bristles. The bristles have a greater height than a maximum diameter. In certain embodiments, as shown, the bristles are formed as an integral unitary structural part of the support platform 40. In other embodiments, the bristles are discrete separate elements attached individually to and not formed as a unitary part of platform 40.

Figure 8:
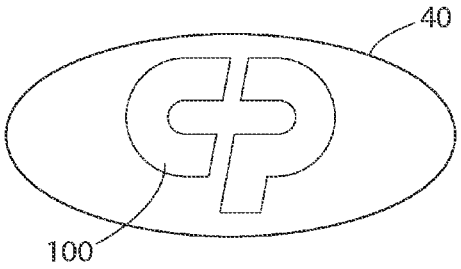
FIG. 8 is a top plan view of the product support platform showing an arrangement of indicator protrusions in the form of a company logo.

Variously shaped indicator protrusions 100 may also be combined to form alphanumeric characters and/or other designs including company logos. FIG. 8 shows one possible embodiment of indicator protrusions 100 forming alphabetical characters representing a company logo.

Accordingly, numerous variations of indicator protrusions 100 are possible long as the protrusions are operable to provide a visual and tactile indication of impending stick product depletion to the user.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A dispensing system for dispensing a solid stick product comprising:

a dispenser having a tubular barrel with an open end and defining an axial centerline;

a solid stick product disposed in the tubular barrel;

a moveable platform disposed in the tubular barrel and supporting the solid stick product;

an actuator mechanism operable to move the moveable platform axially in the tubular barrel towards the open end for dispensing the solid stick product; and a plurality of spaced apart indicator protrusions extending axially outwards from the moveable platform, the plurality of spaced apart indicator protrusions being embedded in the solid stick product and forming interstitial recesses holding a reserve volume of the solid stick product;

wherein after repeated applications of the solid stick product by [[the]] a user, the solid stick product abrades away and the plurality of spaced apart indicator protrusions become exposed to provide a tactile and visual indication that the solid stick product is near depletion, and wherein the plurality of spaced apart indicator protrusions are formed of a first material and the moveable platform is formed of a second material, the second material having a higher Shore A hardness than the first material.

2. A dispensing system for dispensing a solid stick product comprising:

a dispenser having a tubular barrel with an open end and defining an axial centerline;

a solid stick product disposed in the tubular barrel;

a moveable platform disposed in the tubular barrel and supporting the solid stick product;

an actuator mechanism operable to move the moveable platform axially in the tubular barrel towards the open end for dispensing the solid stick product; and a plurality of spaced apart indicator protrusions extending axially outwards from the moveable platform, the plurality of spaced apart indicator protrusions being embedded in the solid stick product and forming interstitial recesses holding a reserve volume of the solid stick product;

wherein after repeated applications of the solid stick product by a user, the solid stick product abrades away and the plurality of spaced apart indicator protrusions become exposed to provide a tactile and visual indication that the solid stick product is near depletion, wherein the plurality of spaced apart indicator protrusions are shaped as bristles each having a height greater than a maximum diameter of the bristle, and wherein the plurality of spaced apart indicator protrusions are resiliently moveable, such that directly engaging the plurality of spaced apart indicator protrusions with the skin of the user results in deforming the plurality of spaced apart indicator protrusions.

3. The dispensing system of claim 1, wherein the plurality of spaced apart indicator protrusions are made of an elastomeric material.

4. The dispensing system of claim 3, wherein the plurality of spaced apart indicator protrusions are molded to the moveable platform.

5. The dispensing system of claim 1, wherein the plurality of spaced apart indicator protrusions are discrete separate components attached to the moveable platform and made from a different material than the moveable platform, the plurality of spaced apart indicator protrusions being deformable in response to a user rubbing the plurality of spaced apart indicator protrusions across their skin.

6. The dispensing system of claim 5, wherein each of the plurality of spaced apart indicator protrusions includes a base portion for attaching the plurality of spaced apart indicator protrusions to the moveable platform, the base portions being individually attached to a top surface of the moveable platform.

7. The dispensing system of claim 5, wherein at least some of the plurality of spaced apart indicator protrusions share a common base portion for attaching a group of the plurality of spaced apart indicator protrusions to a top surface of the moveable platform.

8. The dispensing system of claim 5, wherein the moveable platform includes a plurality of raised anchors, the plurality of spaced apart indicator protrusions being formed around at least some of the plurality of raised anchors for securing the plurality of spaced apart indicator protrusions to the moveable platform.

9. The dispensing system of claim 1, wherein the plurality of spaced apart indicator protrusions are shaped as elongated raised bars extending transversely to the axial centerline of the dispenser and having a length greater than a height of the elongated raised bars.

10. The dispensing system of claim 1, wherein the plurality of spaced apart indicator protrusions are shaped as round pegs in top plan view.

11. The dispensing system of claim 1, wherein the plurality of spaced apart indicator protrusions are shaped as bristles each having a height greater than a maximum diameter of the bristle.

12. The dispensing system of claim 1, wherein the plurality of spaced apart indicator protrusions are shaped to collectively form alphanumeric symbols or a logo.

13. The dispensing system of claim 1, wherein the reserve volume of the solid stick product is sufficient to provide at least one additional application to the user.

14. The dispensing system of claim 1, wherein the solid stick product comprises a deodorant or anti-perspirant.

15. The dispensing system of claim 1, wherein the actuator mechanism includes a rotatable elevator screw and actuator knob rigidly connected thereto, the rotatable elevator screw being coupled to the moveable platform and operable such that turning the actuator knob translates the moveable platform towards the open end of the tubular barrel.

16. A dispenser for a solid stick product comprising:

a tubular barrel having an open end, the solid stick product disposed in the tubular barrel;

a moveable platform disposed in the tubular barrel, the moveable platform having a top surface supporting the solid stick product;

an actuator mechanism operable to move the moveable platform in the tubular barrel to dispense the solid stick product through the open end; and at least one indicator protrusion extending from the top surface of the moveable platform, the at least one indicator protrusion being embedded in the solid stick product;

wherein after repeated applications of the solid stick product by a user, the solid stick product abrades away and the at least one indicator protrusion becomes exposed to provide an indication that the solid stick product is near depletion, and wherein the at least one indicator protrusion is formed of a first material and the moveable platform is formed of a second material, the second material having a higher Shore A hardness than the first material.

17. The dispenser according to claim 16, wherein the indication is a tactile and visual indication.

18. The dispenser according to claim 16, wherein the at least one indicator protrusion is a different color than the solid stick product.

19. The dispenser according to claim 16, wherein the solid stick product is a different color or texture than the moveable platform.

20. The dispenser according to claim 16, wherein the at least one indicator protrusion comprises an elastomeric material and the moveable platform comprises a rigid material.

21. The dispenser according to claim 16, wherein the at least one indicator protrusion comprises an upper indicator surface, and wherein a reserve volume of the solid stick product is located below the upper indicator surface of the at least one indicator protrusion.

22. The dispenser according to claim 16, further comprising a plurality of indicator protrusions extending from the top surface of the moveable platform and embedded in the solid stick product, and wherein interstitial recesses are formed between the plurality of indicator protrusions in which a reserve volume of the solid stick product is disposed.

23. The dispenser according to claim 21, wherein the reserve volume of the solid stick product is equal to X times a predetermined average per usage volume of the solid stick product, wherein X is an integer greater than or equal to 1.

24. The dispenser according to claim 23, further comprising indicia that relays to the user the reserve volume of the solid stick product.

25. The dispenser according to claim 16, further comprising a plurality of indicator protrusions extending from the top surface of the moveable platform and embedded in the solid stick product, and wherein each of the plurality of indicator protrusions includes a base portion attaching the indicator protrusion to the top surface of the moveable platform, the base portions being isolated from one another.

26. The dispenser according to claim 16, further comprising a plurality of indicator protrusions extending from the top surface of the moveable platform and embedded in the solid stick product, wherein at least some of the plurality of indicator protrusions share a common base portion attaching a group of the plurality of the indicator protrusions to the top surface of the moveable platform.

27. A method for indicating impending depletion of a solid stick product from a dispenser, the method comprising:

providing a dispenser including a solid stick product disposed in an axially extending barrel having a completely open end, a moveable platform slidably disposed in the axially extending barrel and supporting the solid stick product, and an actuator mechanism operable to move the moveable platform axially towards the open end of the axially extending barrel for dispensing the solid stick product;

a user repeatedly projecting the solid stick product outwards from the dispenser using the actuator mechanism to expose a portion of the solid stick product;

the user repeatedly applying the exposed portion of solid stick product to their body by rubbing the exposed portion against their skin;

repeatedly abrading away the exposed portion of the solid stick product with each application;

directly engaging a plurality of exposed indicator protrusions embedded in the exposed portion of the solid stick product with the skin of the user;

the user applying the exposed portion of the solid stick product with the plurality of exposed indicator protrusions embedded therein to their body at least one additional time by rubbing the exposed portion and the plurality of exposed indicator protrusions against their skin; and the user applying a reserve volume of the solid stick product stored in interstitial recesses formed between the plurality of exposed indicator protrusions to their body, wherein the plurality of exposed indicator protrusions are resiliently moveable, and the directly engaging step includes deforming the plurality of exposed indicator protrusions when the user engages the plurality of exposed indicator protrusions with their skin.

28. The method of claim 27, wherein the plurality of exposed indicator protrusions extend above the top end of the dispenser when the plurality of exposed indicator protrusions are exposed.

* * * * *